US005464063A

United States Patent [19]

Boehm, Jr.

[11] Patent Number: 5,464,063

[45] Date of Patent: Nov. 7, 1995

[54] WELL ASSEMBLY METAL SEAL

[75] Inventor: Carl F. Boehm, Jr., Houston, Tex.

[73] Assignee: ABB Vetco Gray Inc., Houston, Tex.

[21] Appl. No.: 292,986

[22] Filed: Aug. 19, 1994

[51] Int. Cl.[6] ..... E21B 33/04

[52] U.S. Cl. ..... 166/382; 166/208; 166/387; 277/117; 277/236

[58] Field of Search ..... 166/382, 208, 166/182, 115, 387; 277/117, 236; 285/140

[56] References Cited

U.S. PATENT DOCUMENTS

| | | | |
|---|---|---|---|
| 4,691,780 | 9/1987 | Galle, Jr. et al. | 166/208 X |
| 4,757,860 | 7/1988 | Reimert | 166/208 |
| 4,771,832 | 9/1988 | Bridges | 166/380 |
| 4,823,871 | 4/1989 | McEver et al. | 166/182 |
| 4,911,245 | 3/1990 | Adamek et al. | 166/387 |
| 5,067,734 | 11/1991 | Boehm, Jr. | 277/236 |
| 5,076,356 | 12/1991 | Reimert | 166/115 |
| 5,094,297 | 3/1992 | Bridges | 166/382 |
| 5,129,660 | 7/1992 | Taylor et al. | 277/117 |
| 5,193,616 | 3/1993 | Hynes | 166/208 |
| 5,355,961 | 10/1994 | Gariepy et al. | 166/387 |

*Primary Examiner*—Hoang C. Dang
*Attorney, Agent, or Firm*—James E. Bradley

[57] ABSTRACT

A well has a metal seal for sealing between tubular inner and outer members. The seal has a solid metal body with an inner wall and an outer wall that are cylindrical. The radial thickness of the seal is initially greater than the pocket between the inner and outer tubular members. Also, the inner diameter is greater than the outer diameter of the inner tubular member. The seal is radially deformed in an interference fit.

24 Claims, 3 Drawing Sheets

WELL ASSEMBLY METAL SEAL

BACKGROUND OF THE INVENTION

1. Field of the Invention

This invention relates in general to seals for wellhead assemblies, and in particular to an annulus metal seal for a tubing hanger, casing hanger or the like.

2. Description of the Prior Art

In wellheads, seals are used to seal the annulus between concentric inner and outer tubular members. Particularly with subsea wells and high pressure wells, metal seals are desirable. Metal seals will last longer, withstand higher temperatures, and also will seal at higher pressures than elastomeric seals. There are a variety of metal seals. The seals are set or energized by employing a large downward force to cause the seals to deform against the two sealing surfaces.

In some instances, it may desirable to energize two metal seals simultaneously. For example, in a tubing hanger which has a lateral flow passage. Annular seals which locate above and below this passage have in the past been elastomeric seals. Because of axial tolerances and the high forces required for metal-seals, metal seals are not employed for this purpose at this time to applicant's knowledge.

SUMMARY OF THE INVENTION

In this invention, a metal seal is employed that has a solid metal body. The seal is initially dimensioned so that its radial cross section is thicker than the distance between the inner and outer tubular members. Also, the inner diameter of the seal is smaller than the outer diameter of the inner tubular member. The outer diameter is less than the inner diameter of the bore.

The seal is set with an interference fit using radial deformation. A force due to radial interference with the inner wall deforms the outer wall of the seal outward into sealing engagement with the bore of the outer tubular member. In one embodiment, this is handled by positioning the seal in a recess below the sealing surface of the inner tubular member. The inner tubular member is lowered into the outer tubular member. The seal will contact a stop shoulder in the outer tubular member. Continued downward movement of the inner tubular relative to the seal then forces the seal radially into the outer member sealing area.

In a second embodiment, the seal is positioned above the pocket and a running tool pushes the seal downward into the pocket. The difference in diameters of the pocket and the seal forces the seal to radially deform in an interference fit.

Preferably, both the inner and outer surfaces of the seal contain grooves with inlays of soft metal. The inlay on the exterior helps seal the metal seal to the bore. The inlay on the interior assists in the sliding movement that occurs when the seal is deformed into its sealing position.

DETAILED DESCRIPTION OF THE INVENTION

Figure 1:
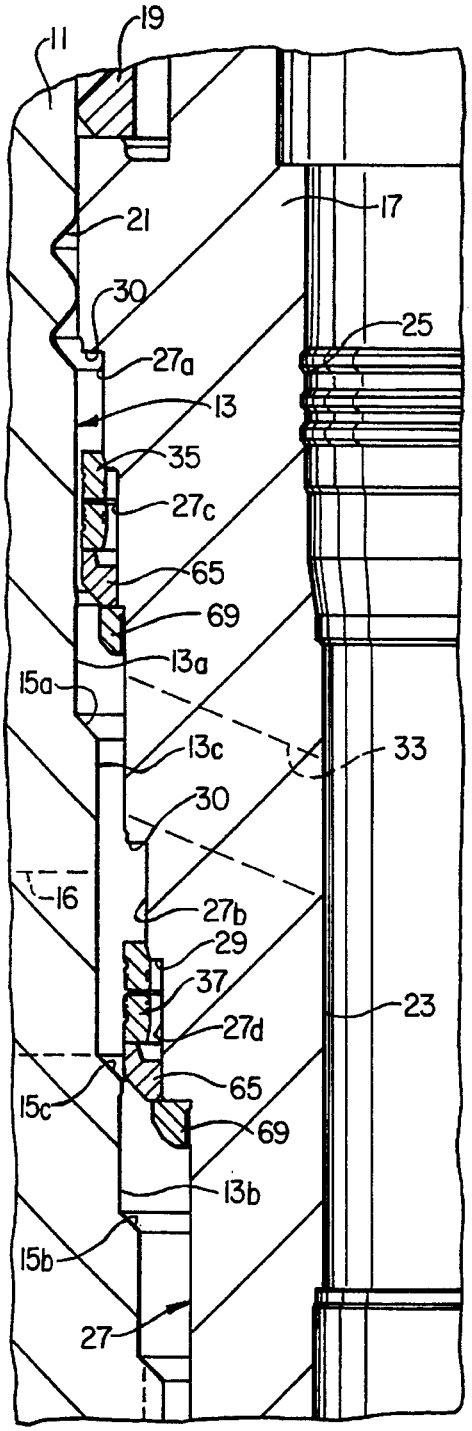
FIG. 1 is a partial quarter sectional view illustrating a wellhead assembly constructed in accordance with this invention and showing the tubing hanger being lowered into the wellhead housing.
Figure 2:
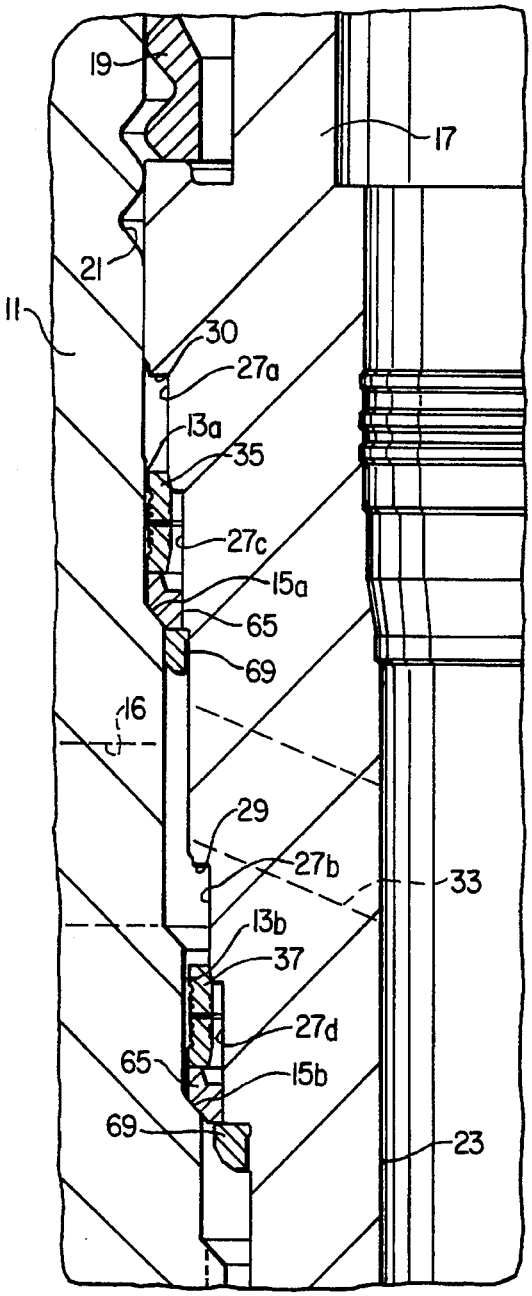
FIG. 2 is another quarter sectional view of the wellhead assembly of FIG. 1 and showing the support rings for the seal landed on stop shoulders, but with the tubing hanger not yet in its lower position.

Referring to FIG. 1, the wellhead 11 shown in the example is a particular type of completion tree for a wellhead, referred to as a horizontal tree. Wellhead 11 is an outer tubular member connected to the upper end of a wellhead housing (not shown) which contains casing hangers which support strings of casing. Wellhead 11 has a bore 13 extending through it that is axial and cylindrical.

Bore 13 has an upper sealing area 13*a*, a lower sealing area 13*b*, and a flow area 13*c* located between the upper and lower sealing areas 13*a*, 13*b*. The surfaces of the upper and lower sealing areas 13*a*, 13*b* are preferably smooth. The inner diameter of upper sealing area 13*a* is greater than the inner diameter of flow area 13*c*, which in turn has a greater inner diameter than the lower sealing area 13*b*. A conical upper stop shoulder 15*a* separates the upper sealing area 13*a* from the flow area 13*c*. A lower stop shoulder 15*b* forms the lower end of lower sealing area 13*b*. An intermediate shoulder 15*c* separates the lower sealing area 13*b* from the flow area 13*c*. A wellhead flow passage 16 extends laterally out through the sidewall of wellhead 11 between shoulder 15*c* and stop shoulder 15*a*.

A tubing hanger 17 is shown partially lowered into wellhead 11. Tubing hanger 17 is an inner tubular member held in wellhead 11 by a locking ring 19 for engaging grooves 21 formed in bore 13. Tubing hanger 17 will be connected to a string of production tubing (not shown) for receiving production fluid from the well. Tubing hanger 17 has a bore 23 which has lockdown grooves 25 near its upper end. Lockdown grooves 25 are used to secure a crown plug (not shown).

Tubing hanger 17 has an outer cylindrical wall 27. Outer wall 27 has an upper sealing area 27*a* and a lower sealing area 27*b* that will align axially with the outer member or bore sealing areas 13*a* and 13*b* once tubing hanger 17 is landed. The surfaces of upper and lower sealing areas 27*a*, 27*b* are preferably smooth. Outer wall 27 also has an upper recess 27*c* located directly below upper sealing area 27*a*. Upper recess 27*c* is of a smaller outer diameter than upper sealing area 27*a*. Similarly, a lower recess 27*d* locates below, defining the lower end of lower sealing area 27*b*.

Figure 3:
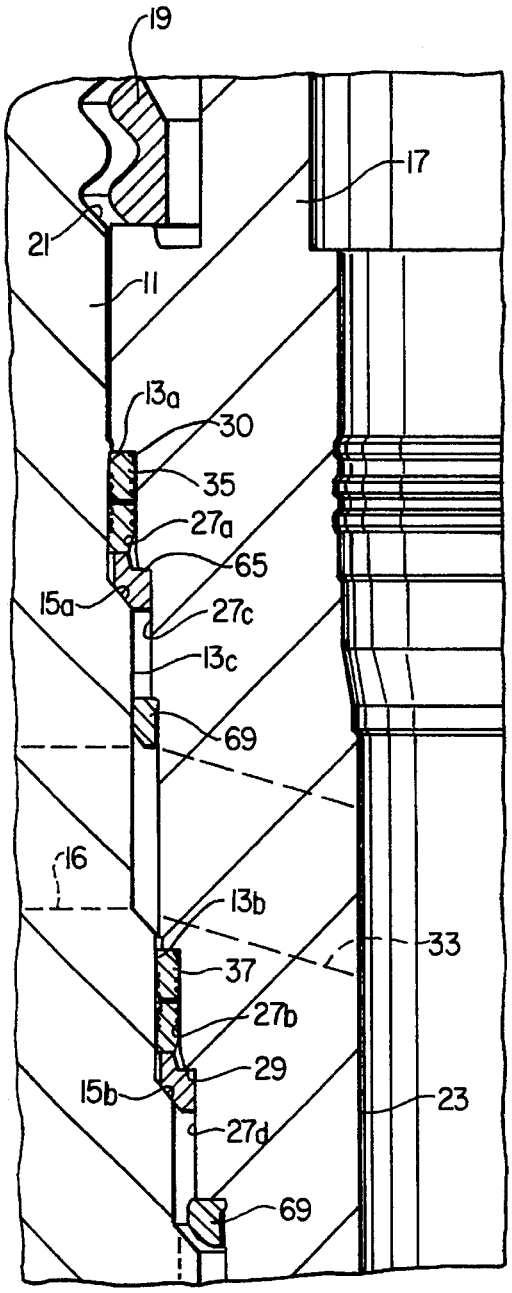
FIG. 3 is another quarter sectional view of the wellhead assembly of FIG. 1, showing the tubing hanger in its lower position with the seals set.
Figure 4:
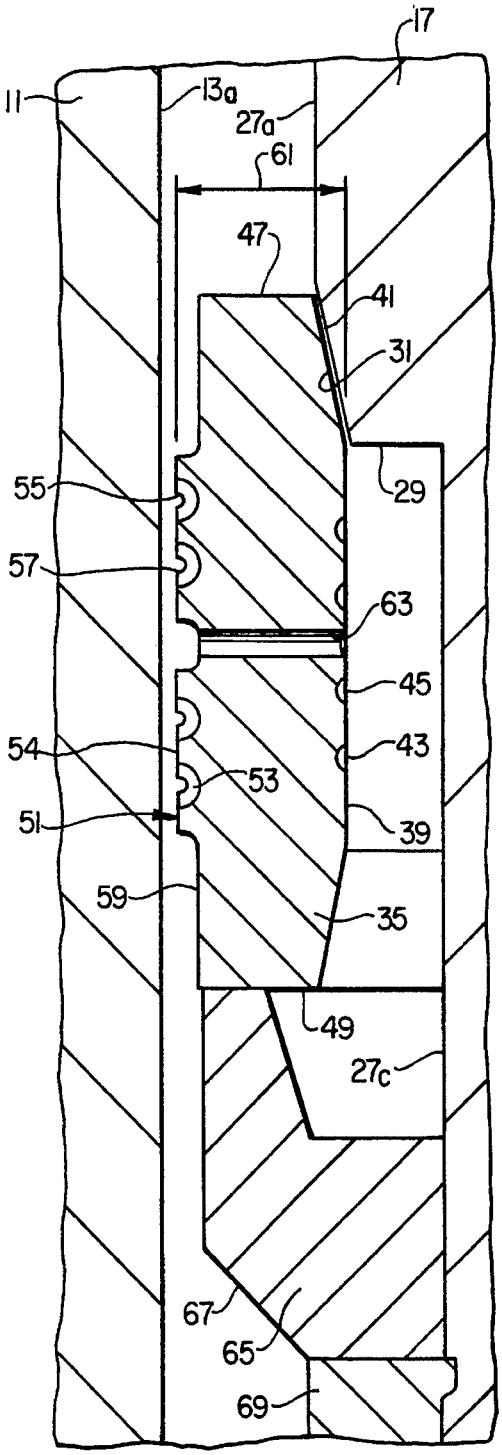
FIG. 4 is an enlarged partial quarter sectional view of the seal, shown prior to contacting the stop shoulder in the wellhead.

Referring to FIG. 4, upper recess 27*c* has at its upper end a downward facing shoulder 29. Recess shoulder 29 is perpendicular to the longitudinal axis of bore 13. A lead-in taper or bevel 31 is formed at the junction of recess shoulder 29 with upper sealing area 27*a*. A similar recess shoulder 29 and bevel exist at lower recess 27*d*. A downward facing shoulder 30 is formed at the upper end of each of the sealing area 27*a*, 27*b*. Referring again to FIG. 1, flow passage 33 extends laterally through the sidewall of tubing hanger 17. Once registered as shown in FIG. 3, production fluid from tubing hanger bore 23 will flow through the lateral passages 33 and 16 for processing.

An upper seal 35 will seal between bore upper sealing area 13*a* and tubing hanger upper sealing area 27*a*. A lower seal 37 will seal between bore lower sealing area 13*b* and tubing hanger sealing area 27*b*. Upper and lower seals 35 and 37 are identical to each other except for diameters. Referring to FIG. 4, which shows upper seal 35, the discussion of this seal will also apply to lower seal 37. Upper seal 35 has a generally rectangular cross-section as shown in FIG. 4. Upper seal 35 has an inner wall 39 that has a cylindrical portion. Conical bevels 41 are located at the upper and lower ends of inner wall 39. Bevel 41 matches the bevel 31 formed on the tubing hanger upper sealing area 27*a*.

The cylindrical portion of the inner wall 39 has a plurality of grooves 43. Grooves 43 are circumferential and spaced axially apart from each other. Each groove 43 is a shallow, generally circular depression. An inlay 45 of soft metal is filled in each depression for lubrication and sealing. Preferably, inlay 45 is filled completely within each groove 43. The type of sealing material is preferably an alloy of tin and indium. This material is a lubricant and is much softer than the material of the body of upper seal 35, which is preferably of steel. Seal 35 has an upper end 47 and a lower end 49 that are perpendicular to the axis of bore 13.

Seal 35 has an outer wall 51 which is cylindrical and parallel to inner wall 39. Outer wall 51 also has a plurality of grooves 53. Grooves 53 are separated by lands 54, and each groove 53 is circumferential and contains an inlay 55 of a soft metal of the same type as inlay 45. Inlay 55 preferably does not completely fill the space within each groove 53 because lands 54 will deform. Rather, a v-shaped groove 57 is formed in each inlay 55. Lands 54 all protrude from a recess portion 59 above and below the grooves 53, which allows deformation of lands 54 when sealing. Grooves 53 are deeper and larger in width than grooves 43, and also contain more of the inlay 55.

Upper seal 35 has an initial radial thickness or dimension 61 measured from the inner sealing surface at inner wall 39 to the outer sealing surface or lands 54 of outer wall 51. This initial radial thickness, measured prior to installation, is significantly greater than the difference between the inner diameter of the bore upper sealing area 13*a* and the outer diameter of the tubing hanger upper sealing area 27*a*. Also, the inner diameter of the sealing surface of seal inner wall 39 is initially significantly less than the outer diameter of the tubing hanger upper sealing area 27*a*. However, the outer diameter of the upper seal outer wall 51 at lands 54 is initially significantly less than the inner diameter of the bore upper sealing area 13*a*. The initial dimensions of the upper seal 39*a* will change when deformed in an interference fit. Upper seal 35 optionally may have a test port 63 that extends radially through it between upper end 47 and lower end 49. Test port 63 enables testing of seal 35 after sealing. Other than test port 63, the body of seal 35 is solid.

FIGS. 1 and 4 show upper seal 35 in an initial position prior to being set. In this initial position, upper seal 35 is supported on tubing hanger 17 by a solid metal support ring 65. Support ring 65 is capable of sliding axially on the upper recess 27*c* of tubing hanger 17. It has an upper portion that contacts the lower end 49 of upper seal 35. Support ring 65 has a conical downward facing shoulder 67 that mates with the stop shoulder 15*a*. Support ring 65 has a smaller inner diameter than the inner diameter of seal 35 and has an upper shoulder that is contacted by the recess shoulder 29 when tubing hanger 17 is in the lower position.

Support ring 65 is prevented from further downward movement on tubing hanger 17 by a retainer ring 69. Retainer ring 69 is rigidly secured to tubing hanger 17. A similar support ring 65 and retainer ring 67 are employed in connection with the lower seal 37.

In operation of the embodiment of FIGS. 1–4, tubing hanger 17 will be secured to the upper end of the string of production tubing (not shown). Upper and lower seals 35, 37 will be assembled in the initial position shown in FIG. 1. In this position, seal 35 will be located adjacent upper recess 27*c* and spaced therefrom by a clearance. Lower seal 37 will located adjacent lower recess 27*d*. The bevels 41 (FIG. 4) will be engaging the bevels 31 on the tubing hanger 17. In this position, the seals 35, 37 are in undeformed conditions.

The operator lowers the tubing hanger 17 into the bore 13, as shown in FIG. 1. A substantial clearance will exist between the seals 35, 37 and the bore sealing areas 13*a*, 13*b*. The support rings 65 will contact the upper and lower stop shoulders 15*a*, 15*b* shown in FIG. 2. The engagement of the support rings 65 with the stop shoulders 15*a*, 15*b* will be approximately at the same time, but because of tolerances would likely not be precisely simultaneous. At this point, upper and lower seals 35, 37 will be prevented from any further downward movement with tubing hanger 17.

The operator continues to move tubing hanger 17 downward. Substantial force is necessary and this may be handled by the running tools of various types. As the tubing hanger 17 moves downward, the sealing areas 27*a* and 27*b* will slide on the inner walls 39 of the seals 35, 37. Because of the substantial difference between the initial inner diameters of seals 35, 37 and sealing areas 27*a*, 27*c*, the seals 35, 37 will radially deform outward. This radial outward deformation forces the outer walls 51 of seals 35, 37 radially outward into sealing engagement with the bore sealing areas 13*a*, 13*b*. The lands 54 will deform, causing a portion of each of the inlays 55 to flow out of grooves 53 to assist in sealing against the sealing areas 13*a*, 13*b*. A portion of each of the inlays 45 will flow from the grooves 43, lubricating the surfaces 27*a*, 27*b* as they slide past. Tubing hanger 17 moves downward until recess shoulders 29 contact support rings 65. The force from the setting tool is released. The downward load on tubing hanger 17 due to the weight of tubing transfers from recess shoulder 29 to support ring 65 and to wellhead 11 through shoulders 15*a*, 15*b*.

In the final position, shown in FIG. 3, the seals 35, 37 will be tightly and interferingly secured in the pockets formed between the upper sealing areas 13*a*, 27*a* and lower sealing areas 13*b* and 27*b*. The radial dimension 61 (FIG. 4) will have contracted to the dimensions between the sealing areas 13*a*, 27*a* and 13*b*, 27*b*. Substantially no deformation of the sealing areas 13*a*, 27*a*, 13*b*, 27*b* occurs. The seals 35, 37 will radially set fully without any axial compression existing after engagement with the stop shoulders 15*a*, 15*b*. A slight clearance will preferably exist between each of the seal upper ends 47 and the shoulders 30 (FIG. 1). Once the recess shoulders 29 contact the support rings 65, tubing hanger 17 will not be able to move further downward in wellhead 11, therefore the sealing area upper shoulders 30 will not axially compress the seals 35, 37. In the final position, shown in FIG. 3, the retainer rings 69 will be spaced below the support rings 65.

Once in place, a setting mechanism (not shown) will cause the lock ring 19 to engage the grooves 21 to lock the tubing hanger 17 in that position. A cap (not shown) will be placed on wellhead 11, preventing flow upward past tubing hanger 17. The production fluids will flow out the lateral passages 33, 16. The seals 35, 37 seal the fluid in the flow area 13*c*.

Figure 5:
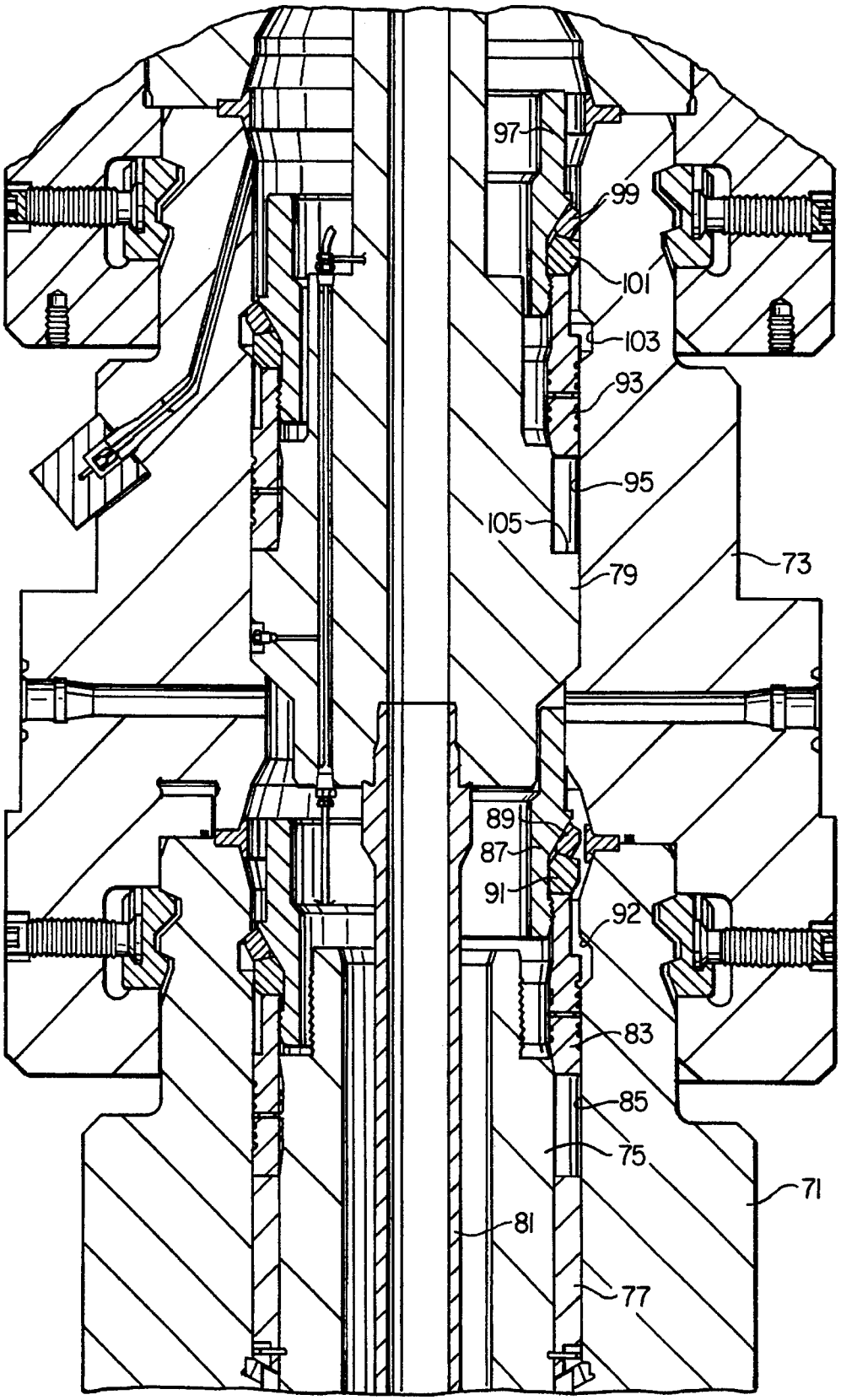
FIG. 5 is a half sectional view of another wellhead, showing two seals in accordance with this invention being installed in a different manner, with the right side of the drawing showing the seals prior to being set and the left side showing the seals after setting.

The second embodiment of FIG. 5 shows the invention applied to a well assembly that is not a horizontal tree type as in the first embodiment. The well assembly includes a wellhead housing 71, which is an outer tubular member located at the upper end of a well. A tubing hanger spool 73 connects to the upper end of wellhead housing 71. A casing hanger 75 lands within wellhead housing 71. Casing hanger 75 is an inner tubular member secured to a string of casing extending into the well. Casing hanger 75 is shown having a sleeve 77 mounted to it. A tubing hanger 79 lands in the tubing spool 73, which is an outer tubular member. Tubing hanger 79 is an inner tubular member secured to the upper end of a string of production tubing 81, which extends through the casing.

A metal casing hanger seal 83 seals in an annular pocket 85 between casing hanger 75 and the bore of wellhead housing 71. Seal 83 is identical to the seals 35, 37 (FIGS. 1–4) previously described, except for dimensions. It is shown in an initial upper position on the right side of FIG. 5, and a lower set position on the left side. It fits within pocket 85 in an interference fit, with its initial dimensions differing from the dimensions of pocket 85 in the same manner as previously described in connection with the first embodiment.

It is set differently, however. A setting sleeve 87 is adapted to be connected to a running tool (not shown), prior to the installation of tubing hanger 79. Setting sleeve 87 has a lock ring 89 and a reaction ring 91 located below and between the upper end of seal 83. The running tool drives the setting sleeve 87 downward, forcing the seal 83 into the pocket 85 while the casing hanger 75 and wellhead housing 71 are stationary. The seal 83 contacts the upper end of casing hanger sleeve 77. Lock ring 89 is wedged outward into a recess 92 to hold seal 83 in place by continued downward movement of setting sleeve 87 after seal 83 is in its set position shown on the left side. The radial interference causes the deformation of seal 83, not any axial compression after seal 83 lands on casing hanger sleeve 77.

After seal 83 is set, the tubing hanger 79 is landed. A similar arrangement is employed to set a tubing hanger seal 93 in a pocket 95 between tubing hanger 79 and tubing hanger spool 73. A setting sleeve 97 moves seal 93 downward through a lock ring 99 and a reaction ring 101. When seal 93 is in the lower set position on a shoulder 105 of the tubing hanger 79, as shown on the left side, continued downward movement of setting sleeve 97 wedges the lock ring 99 outward into a recess 103 in the bore of spool 73. The radial interference causes the deformation of the seal 93, not any axial compression after seal 93 lands on shoulder 105. The well fluid is produced upward through the tubing 81 and tubing hanger 79.

The invention has significant advantages. The metal seals effectively seals lateral flow passages in a tubing hanger. The metal seals have other applications as well, singularly or combined with others. The seals deform radially due to radial interference, and need no axial compression once landed to cause the deformation. This allows larger axial tolerances.

While the invention has been shown in only two of its forms, it should be apparent to those skilled in the art that it is not so limited, but is susceptible to various changes without departing from the scope of the invention.

I claim:

1. In a well assembly having a tubular inner member located within a cylindrical axial bore of a tubular outer member, defining an annular pocket between a cylindrical outer wall of the inner member and the bore, an improved seal for sealing in the pocket, comprising:

an annular solid metal body having an inner wall with an inner seal surface and an outer wall with an outer seal surface;

the seal body having an initial radial dimension from its inner seal surface to its outer seal surface prior to locating in the pocket that is initially greater than a radial dimension of the pockets;

the seal body having an initial outer diameter at its outer seal surface prior to locating in the pocket that is initially smaller than an inner diameter of the bore;

the seal body having an initial inner diameter at its inner seal surface prior to locating in the pocket that is initially smaller than an outer diameter of the outer wall of the inner member, the seal body being deformable such that when positioned in the pocket, the seal body deforms in an interference fit causing the inner seal surface to sealingly engage the outer wall of the inner member and the outer seal surface to sealingly engage the bore.

2. The seal according to claim 1 further comprising means for positioning and deforming the seal body in the pocket in response to downward movement of the inner member relative to the outer member and to the seal body.

3. The seal according to claim 1 further comprising means for positioning and deforming the seal body in the pocket in response to downward movement of the seal body relative to the inner and outer members.

4. The seal according to claim 1 wherein the inner and outer walls of the seal are substantially cylindrical both before and after positioning and deforming the seal in the pocket.

5. The seal according to claim 1 wherein the inner seal surface comprises a cylindrical surface containing a plurality of spaced apart circumferential grooves filled with an inlay of metal softer than the metal of the seal body.

6. The seal according to claim 1 wherein the outer seal surface comprises a cylindrical surface containing a plurality of spaced apart circumferential grooves filled with an inlay of metal softer than the metal of the seal body.

7. The seal according to claim 1 wherein each of the inner seal surface and the outer seal surface comprises a cylindrical surface containing a plurality of spaced apart circumferential grooves filled with an inlay of metal softer than the metal of the seal body.

8. The seal according to claim 1 wherein each of the inner seal surface and the outer seal surface comprises a cylindrical surface containing a plurality of spaced apart circumferential grooves filled with an inlay of metal softer than the metal of the seal body, each of the grooves of the outer seal surface being larger in dimension and containing more of the inlay than each of the grooves of the inner seal surface.

9. In a well assembly having a tubular inner member located within a cylindrical axial bore of a tubular outer member, defining an annular pocket between a cylindrical outer wall of the inner member and the bore, the pocket having a cylindrical outer member seal area and a cylindrical inner member seal area, an improved means for sealing the inner and outer member seal areas in the pocket, comprising:

an annular solid metal seal body having a substantially cylindrical inner wall with an inner seal surface and a substantially cylindrical outer wall with an outer seal surface, the seal body being substantially rectangular in cross-section;

the seal body having an initial radial dimension from its inner seal surface to its outer seal surface prior to locating in the pocket that is initially greater than a radial dimension of the pocket;

the seal body having an initial outer diameter at its outer seal surface that is initially smaller prior to locating in the pocket than an inner diameter of the outer member seal area;

the seal body having an initial inner diameter at its inner seal surface prior to locating in the pocket that is initially smaller than an outer diameter of the inner area seal area; and setting means for causing relative axial movement between the inner member and the seal body to position the seal body in the pocket, causing the inner seal surface to slidingly and sealingly engage the inner member seal area, radially outwardly deforming the seal body in an interference fit, and causing the outer seal surface to sealingly engage the outer member seal area.

10. The well assembly according to claim 9 wherein the setting means first positions the seal body in a stationary position adjacent to the outer member seal area, then causes the inner member and inner member seal area to move downward relative to the outer member and the seal body.

11. The well assembly according to claim 9 wherein the inner seal area and outer seal area are initially positioned adjacent to each other to form the pocket prior to receiving the seal body, and wherein the setting means moves the seal body downward relative to the inner and outer member seal areas into the pocket.

12. In a well assembler having a tubular inner member located within a cylindrical axial bore of a tubular outer member defining an annular pocket between a cylindrical outer wall of the inner member and the bore, the pocket having an outer member seal area and an inner member seal area, an improved means for sealing the inner and outer member seal areas in the pocket, comprising:

an annular solid metal seal body having a substantiality cylindrical inner wall with an inner seal surface and a substantially cylindrical outer wall with an outer seal surface, the seal body being substantially rectangular in cross-section;

the seal body having an initial radial dimension from its inner seal surface to its outer seal surface prior to locating in the pocket that is initially greater than a radial dimension of the pocket;

the seal body having an initial outer diameter at its outer seal surface that is initially smaller prior to locating in the pocket than an inner diameter of the outer member seal area;

the seal body having an initial inner diameter at the inner seal surface prior to locating in the pocket that is initially smaller than an outer diameter of inner area seal area; and setting means for causing relative axial movement between the inner member and the seal body to position the seal body in the pocket, causing the inner seal surface to slidingly and sealingly engage the inner member seal area, radially outwardly deforming the seal body in an interference fit, and causing the outer seal surface to sealingly engage the outer member seal area; and wherein the setting means comprises:

an annular recess on the outer wall of the inner member spaced adjacent to and below the inner member seal area;

supporting means for supporting the seal body in an initial position on the inner member in the recess, for allowing the seal body to move downward with the inner member as the inner member is lowered into the outer member; and stop means in the bore for preventing further downward movement of the seal body in the outer member once it locates adjacent to the outer member seal area, causing further downward movement of the inner member relative to the outer member to force the seal body out of the recess and over the inner member seal area, deforming the seal body into sealing engagement with the inner and outer member seal areas.

13. In a well assembly having a tubular inner member located within a cylindrical axial bore of a tubular outer member, defining an annular pocket between a cylindrical outer wall of the inner member and the bore, the pocket having an outer member seal area and an inner member seal area, an improved means for sealing the inner and outer member seal areas in the pocket, comprising:

an annular solid metal seal body having a substantially cylindrical inner wall with an inner seal surface and a substantially cylindrical outer wall with an outer seal surface, the seal body being substantially rectangular in cross-section;

the seal body having an initial radial dimension from its inner seal surface to its outer seal surface prior to locating in the pocket that is initially greater than a radial dimension of the pocket;

the seal body having an initial outer diameter at its outer seal surface that is initially smaller prior to locating in the pocket than an inner diameter of the outer member seal area;

the seal body having an initial inner diameter at its inner seal surface prior to locating in the pocket that is initially smaller than an outer diameter of the inner area seal area; and setting means for causing relative axial movement between the inner member and the seal body to position the seal body in the pocket, causing the inner seal surface to slidingly and sealingly engage the inner member seal area, radially outwardly deforming the seal body in an interference fit, and causing the outer seal surface to sealingly engage the outer member seal area; and wherein the setting means comprises:

an annular recess on the outer wall of the inner member spaced adjacent to and below the inner member seal area;

a supporting ring for supporting the seal body in an initial position on the inner member in the recess, allowing the seal body to move downward with the inner member as the inner member is lowered into the outer member; and a stop shoulder in the bore adjacent to and below the outer member seal area, for stopping further downward movement of the supporting ring and seal body, so that further downward movement of the inner member causes the inner member seal area to move downward in the seal body, deforming the seal body into sealing engagement with the inner and outer member seal areas.

14. In a well assembly having a tubular inner member located within a cylindrical axial bore of a tubular outer member, defining an annular pocket between a cylindrical outer wall of the inner member and the bore, the pocket having an outer member seal area and an inner member seal area, an improved means for sealing the inner and outer member seal areas in the pocket, comprising:

an annular solid metal seal body having a substantially cylindrical inner wall with an inner seal surface and a substantially cylindrical outer wall with an outer seal surface, the seal body being substantially rectangular in cross-section;

the seal body having an initial radial dimension from its inner seal surface to its outer seal surface prior to locating in the pocket that is initially greater than a radial dimension of the pocket;

the seal body having an initial outer diameter at its outer seal surface that is initially smaller prior to locating in the pocket than an inner diameter of the outer member seal area;

the seal body having an initial inner diameter at its inner seal surface prior to locating in the pocket that is initially smaller than an outer diameter of the inner area seal area; and setting means for causing relative axial movement between the inner member and the seal body to position the seal body in the pocket, causing the inner seal surface to slidingly and sealingly engage the inner member seal area, radially outwardly deforming the seal body in an interference fit, and causing the outer seal surface to sealingly engage the outer member seal area; and wherein the setting means comprises:

an annular recess on the outer wall of the inner member spaced adjacent to and below the inner member seal area;

a supporting ring for supporting the seal body in an initial position on the inner member in the recess, allowing the seal body to move downward with the inner member as the inner member is lowered into the outer member;

a stop shoulder in the bore adjacent to and below the outer member seal area, for stopping further downward movement of the supporting ring and seal body, so that further downward movement of the inner member causes the inner member seal area to move downward in the seal body, deforming the seal body into sealing engagement with the inner and outer member seal areas; and a recess shoulder separating the recess from the inner member seal area, the recess shoulder contacting the supporting ring to stop further downward movement of the inner member relative to the outer member and transferring any downward load on the inner member through the supporting ring and stop shoulder to the outer member, the seal body being free of substantially any axial compression when in its final position.

15. The well assembly according to claim 9 wherein both the inner seal surface and the outer seal surface comprise a plurality of spaced apart circumferential grooves filled with an inlay of metal softer than the metal of the seal body.

16. In a well assembly having a tubular inner member which is lowered into and landed within a cylindrical axial bore of a tubular outer member, the improvement comprising in combination:

a stop shoulder formed in the bore, the bore having an outer member seal area extending upward from the stop shoulder and having an inner diameter;

the inner member having an outer wall with a recess and an inner member seal area of larger outer diameter than the recess extending upward from the recess and being separated by a recess shoulder;

an annular metal seal body having a substantially cylindrical inner wall with an inner seal surface and a substantially cylindrical outer wall with an outer seal surface;

the seal body having an initial radial dimension from its inner seal surface to its outer seal surface prior to installation that is initially greater than a radial difference between the inner diameter of the outer member seal area and the outer diameter of the inner member seal area;

the seal body having an initial outer diameter at its outer seal surface that is initially smaller prior to installation than the inner diameter of the outer member seal area;

the seal body having an initial inner diameter at its inner seal surface prior to installation that is initially smaller than the outer diameter of the inner member seal area;

each of the inner and outer seal surfaces comprising a plurality of spaced apart circumferential grooves filled with an inlay of metal softer than the metal of the seal body; and a supporting ring for supporting the seal body in an initial position on the inner member in the recess, allowing the seal body to move downward with the inner member as the inner member is lowered into the outer member until the supporting ring contacts the stop shoulder, which stops further downward movement of the supporting ring and seal body, so that further downward movement of the inner member causes the inner member seal area to move downward relative to the seal body, radially deforming the seal body into sealing engagement with the outer member seal area, the inner member downward movement being stopped by contact of the recess shoulder with the supporting ring.

17. The well assembly according to claim 16, wherein the circumferential grooves of the outer seal surface are located in lands which prior to installation protrude from the outer wall of the seal body, and wherein the inlays of the circumferential grooves of the inner seal surface are prior to installation substantially flush with the inner wall of the seal body.

18. In a well assembly having a tubular inner member secured to a string of production tubing, the inner member being lowered into and landed within a cylindrical axial bore of a tubular outer member, the inner member and the outer member having laterally extending flow passages extending through their sidewalls which register with each to allow flow of fluid from the production tubing out the flow passage of the outer member, an improved means for sealing above and below the flow passages, comprising in combination:

upper and lower stop shoulders formed in the bore and axially spaced from each other, above and below the flow passage of the outer member, the bore having outer member upper and lower seal areas extending upward from the upper and lower stop shoulders respectively, each of the outer member upper and lower seal areas having an inner diameter;

the inner member having an outer wall with upper and lower recesses and upper and lower seal areas extending upward from the upper and lower recesses, respectively, above and below the flow passage of the inner member, each of the upper and lower recesses having at its upper end a downward facing recess shoulder;

annular metal upper and lower seal bodies, each having a substantially cylindrical inner wall with an inner seal surface and a substantially cylindrical outer wall with an outer seal surface;

the upper seal body having an initial radial dimension from its inner seal surface to its outer seal surface prior to installation that is initially greater than a radial difference between the inner diameter of the outer member upper seal area and the outer diameter of the inner member upper seal area, and the lower seal body having an initial radial dimension from its inner seal surface to its outer seal surface prior to installation that is initially greater than a radial difference between the inner diameter of the outer member lower seal area and the outer diameter of the inner member lower seal area;

the upper seal body having an initial outer diameter at its outer seal surface that is initially smaller prior to installation than the inner diameter of the outer member upper seal area, and the lower seal body having an initial outer diameter at its outer seal surface that is initially smaller prior to installation than the inner diameter of the outer member lower seal area;

the upper seal body having an initial inner diameter at its inner seal surface prior to installation that is initially smaller than the outer diameter of the inner member upper seal area, and the lower seal body having an initial inner diameter at its inner seal surface prior to installation that is initially smaller than the outer diameter of the inner member lower seal area; and means for supporting the upper and lower seal bodies in an initial position on the inner member in the upper and lower recesses, respectively, allowing the seal bodies to move downward with the inner member as the inner member is lowered into the outer member until the downward movement of the upper and lower seal bodies is stopped by the upper and lower stop shoulders, respectively, so that further downward movement of the inner member causes the inner member upper and lower seal areas to move downward relative to the upper and lower seal bodies, respectively, radially deforming the upper and lower seal bodies into sealing engagement with the outer member upper and lower seal areas, respectively.

19. The wellhead assembly according to claim 18 wherein downward movement of the inner member is stopped by engagement of the recess shoulders with the upper and lower stop shoulders, transferring downward load on the inner member to the outer member through the stop shoulders.

20. The wellhead assembly according to claim 18 wherein each of the inner and outer seal surfaces of each of the seal bodies comprises a plurality of spaced apart circumferential grooves filled with an inlay of metal softer than the metal of the seal body.

21. In a well assembly having a tubular inner member located within a cylindrical axial bore of a tubular outer member, defining an annular pocket between a cylindrical outer wall of the inner member and the bore, an improved seal for sealing in the pocket, comprising:

an annular solid metal body having an inner wall with an inner seal surface and an outer wall with an outer seal surface;

the seal body having an initial radial dimension from its inner seal surface to its outer seal surface prior to locating in the pocket that is initially greater than a radial dimension of the pocket;

the seal body having an initial inner diameter at its inner seal surface prior to locating in the pocket that is initially smaller than an outer diameter of the outer wall of the inner member in the pocket;

the seal body having an initial outer diameter at its outer seal surface prior to locating in the pocket that is initially smaller than an inner diameter of the bore in the pocket; and setting means for moving the seal body downward into the pocket while the inner and outer members are stationary, the seal body deforming in an interference fit, sealingly engaging the outer wall of the inner member and the bore.

22. A method of sealing an annular pocket between a cylindrical outer wall of a tubular inner member and a cylindrical bore of a tubular outer member of a well assembly, comprising:

providing an annular metal seal body having a substantially cylindrical inner wall with an inner seal surface and a substantially cylindrical outer wall with an outer seal surface, an initial radial dimension from its inner seal surface to its outer seal surface prior to locating in the pocket that is initially greater than a radial dimension of the pocket, an initial outer diameter at its outer seal surface that is initially smaller prior to locating in the pocket than an inner diameter of the bore in the pocket, and an initial inner diameter at its inner seal surface prior to locating in the pocket that is initially smaller than an outer diameter of the outer wall of the inner member in the pocket; and positioning the seal body in the pocket and radially deforming the seal body outward, causing the inner seal surface to sealingly engage the outer wall of the inner member and the inner seal surface to sealingly engage the outer wall of the inner member in an interference fit.

23. The method according to claim 22, wherein the step of positioning the seal body in the pocket and radially deforming the seal body comprises placing the seal body stationarily relative to the outer member in the pocket, and moving the inner member downward relative to the outer member and seal body.

24. The method according to claim 22, wherein the step of positioning the seal body in the pocket radially deforming the seal body comprises moving the seal body downward into the pocket while the inner and outer members are stationary.

* * * * *